United States Patent [19]

Bolson

[11] Patent Number: 4,616,298

[45] Date of Patent: Oct. 7, 1986

[54] WATER-POWERED LIGHT

[76] Inventor: Frank J. Bolson, Rte. 1 - Box 86-#6, Cottonwood, Calif. 96022

[21] Appl. No.: 813,406

[22] Filed: Dec. 26, 1985

[51] Int. Cl.[4] ..... F21V 31/00

[52] U.S. Cl. ..... 362/192; 362/96; 290/54

[58] Field of Search ..... 362/192, 96; 290/54

[56] References Cited

U.S. PATENT DOCUMENTS

| | | | |
|---|---|---|---|
| 3,845,291 | 10/1974 | Portyrata | 362/192 |
| 4,564,889 | 2/1986 | Bolson | 362/192 |

FOREIGN PATENT DOCUMENTS

| | | | |
|---|---|---|---|
| 715943 | 1/1942 | Fed. Rep. of Germany | 362/192 |
| 725214 | 9/1942 | Fed. Rep. of Germany | 362/192 |
| 107088 | 10/1924 | Switzerland | 362/192 |

*Primary Examiner*—Ronald H. Lazarus
*Attorney, Agent, or Firm*—Leonard Bloom

[57] ABSTRACT

A water-powered light for decorative or utilitarian purposes has a stator assembly mounted on the forward end of a fixed shaft within the housing. The shaft is cantilever supported at one end of the housing and projects forwardly therefrom. A rotor assembly is journaled on an intermediate portion of the shaft. The rotor assembly is axially separated from, but in close proximity to, the stator assembly on the end of the fixed shaft; and the rotor assembly carries permanent magnet means for cooperation with a coil in the stator assembly. A lamp assembly is mounted on the stator assembly forwardly thereof, and a lens cap is mounted on the housing forwardly of the lamp assembly. Water under pressure enters into the housing and passes through canals in a stationary disc member to impinge on an impeller nested within the disc member, the impeller being part of the rotor assembly. The water exits from the impeller, passes around the stator assembly and the lamp assembly and into the lens cap, and exits as a fine spray out of apertures formed in a flat end wall of the lens cap.

16 Claims, 12 Drawing Figures

WATER-POWERED LIGHT

CROSS-REFERENCE TO COPENDING APPLICATION

The present invention constitutes an improvement to my co-pending application, Ser. No. 629,329 filed July 10, 1984 for a "Hydro Light" now U.S. Pat. No. 4,564,889.

FIELD OF THE INVENTION

The present invention relates to a water-powered light, and more particularly, to a water-powered light that may be used for decorative purposes in a swimming pool or the like, or for utilitarian purposes in connection with emergency sprinkler systems.

BACKGROUND OF THE INVENTION

Water-powered lights have been disclosed in the prior art, wherein water under pressure is directed to a propeller or turbine for turning a shaft, and wherein the shaft drives a small electric generator for energizing a flashlight-type of bulb for illumination purposes.

However, the constructions resorted to in the prior art are cumbersome and costly, somewhat unreliable in performance, and as a result have not met with substantial commercial success.

SUMMARY OF THE INVENTION

Accordingly, it is an object of the present invention to alleviate the disadvantages and deficiencies of the prior art by providing an improved construction of a water-powered light, one that is economical to produce, elegant in its design, and reliable in its performance.

In accordance with the teachings of the present invention, a preferred embodiment is herein disclosed, wherein the water-powered light has a housing having a pair of end portions, one of which is substantially closed and the other of which is substantially open. A stationary shaft means has one end thereof cantilever supported at the closed end portion of the housing. The shaft means projects therefrom substantially axially of the housing and has a free end within the housing. A rotor assembly is journaled on the shaft means, and the rotor assembly includes an impeller and further includes a rotor member. Passageway means are formed within the closed end portion of the housing for directing the flow of water to the impeller, thereby driving the rotor assembly. A permanent magnet means is carried on the rotor member. A stator assembly is mounted on the free end of the shaft means, and the stator assembly is disposed axially forwardly of the rotor assembly and has an annular clearance relative to the housing. The stator assembly includes a stator housing having first and second stator members secured therein, and a coil is nested between the stator members. A lamp assembly is disposed in the housing forwardly of the stator assembly and is electrically connected thereto. A lens means is mounted on the open end portion of the housing forwardly of the lamp assembly; and the lens means has aperture means formed therein, whereby the water may flow out of the rotor assembly, through the annular clearance between the stator assembly and the housing, and out of the aperture means in the lens means.

These and other objects of the present invention will become apparent from a reading of the following specification, taken in conjunction with the enclosed drawings.

GENERAL DESCRIPTION OF THE PREFERRED EMBODIMENT

Figure 5:
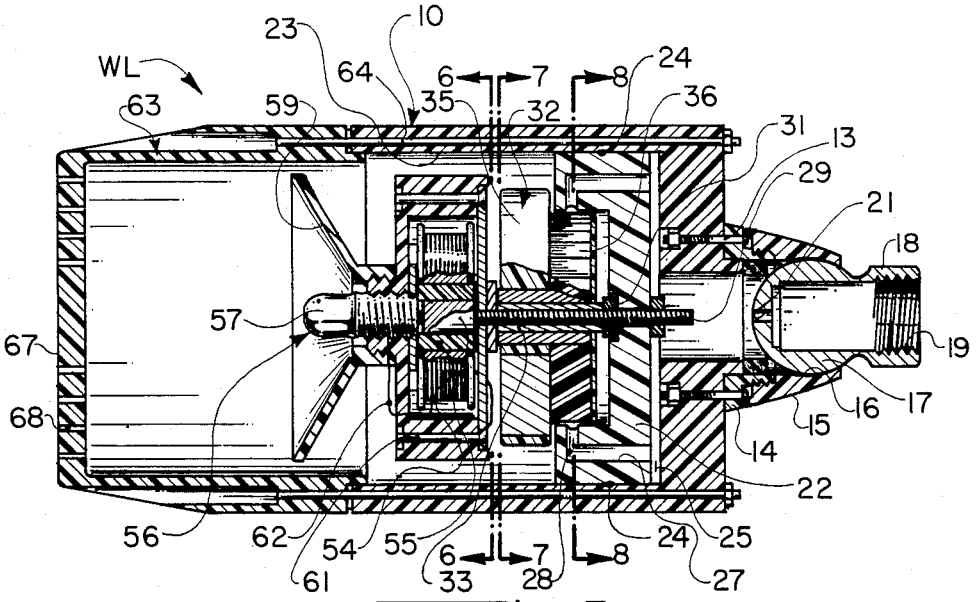
FIG. 5 is a longitudinal section, taken along the lines 5—5 of FIG. 2.

With reference to the drawings, and more particularily to FIG. 5, there is disclosed a preferred embodiment of the water-powered light WL of the present invention. The light WL includes a generally cylindrical housing 10 having a rearward portion closed by an end wall 11 and further having a forward open end 12. The end wall is secured by screws 13 to a collar 14, and the collar is externally threaded to secure a clamping member 15. The clamping member 15 has a spherical seat 16 for receiving the ball portion 17 of a coupling 18, thereby providing a swivel adjustment for the water light WL. The coupling 18 has internal threads 19 for connection to a source of water under pressure, and a port 20 in the ball communicates with a chamber 21 formed within the end wall of the housing. Preferably, a gasket 17A is lodged between the ball and the collar.

A disc member 22 is secured within the blind axial bore 23 of the cylindrical housing by means of adhesive, as at 24. The disc member is disposed substantially adjacent to the end wall of the housing, but is spaced axially therefrom to form a plenum 25 communicating with the chamber in the end wall of the housing, as shown more clearly in FIG. 5. The disc member has a relatively-shallow blind axial bore 26 opening forwardly of the housing. A plurality of circumferentially-spaced axially extending canals 27 are formed in the disc member (in communication with the plenum) and in turn communicate with a corresponding plurality of radially-extending canals 28 opening into the blind axial bore of the disc member.

A stationary (or fixed) shaft means is carried by the disc member. Preferably, the shaft means comprises a threaded shaft or bolt 29 having one end thereof anchored to the disc member by nuts 30 and 31 (or other suitable means). Thus the shaft is cantilever supported within the rear portion of the housing (being carried by the disc member within the housing) and extends forwardly therefrom.

Figure 8:
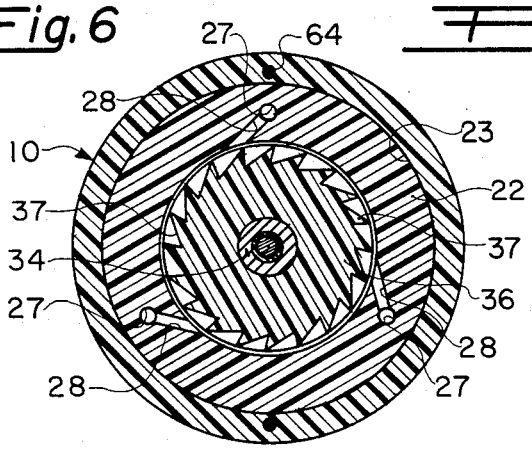
FIG. 8 is a cross-sectional view, taken across the lines 8—8 of FIG. 5, and showing the circumferentially-spaced radial canals for directing the water flow on to the impeller portion of the rotor assembly.

A rotor assembly 32 is journaled on an intermediate portion of the shaft. Preferably, an inner sleeve 33 is press-fitted over the shaft and rotatably supports an outer sleeve (or bushing) 34 carried within the hub of the rotor assembly. The rotor assembly includes a permanent magnet member 35 secured axially forwardly of an impeller 36 (by an adhesive or other suitable means). The impeller 36 is nested within the relatively-shallow blind axial bore of the disc member in communication with the radially-extending canals formed therein. The water under pressure will be directed through the radially-extending canals to the vanes or blades 37 formed on the periphery of the impeller, as shown more clearly in FIG. 8.

Figure 7:
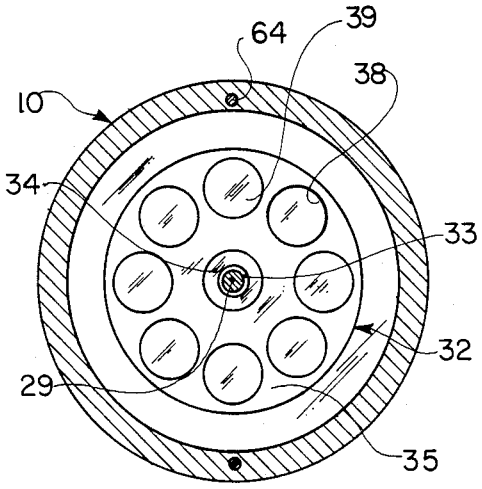
FIG. 7 is a cross-sectional view, taken across the lines 7—7 of FIG. 5, and looking into the front of the rotor assembly and, more particularly, the array of circumferentially-spaced permanent magnets carried by the rotor assembly.
Figure 9:
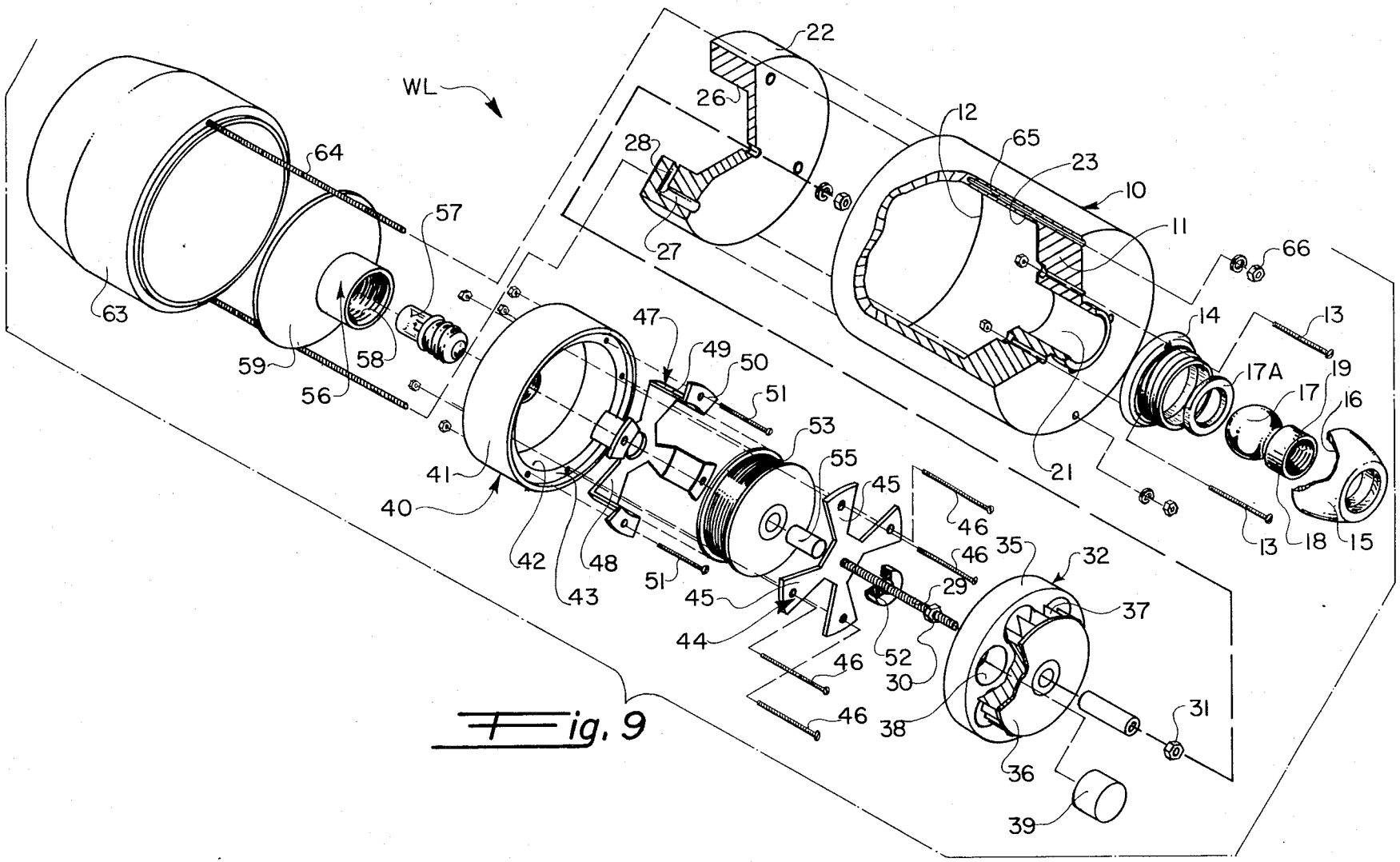
FIG. 9 is an exploded perspective of the preferred embodiment of the water-powered light of the present invention.

The permanent magnet member of the rotor assembly has a plurality of circumferentially-spaced openings 38 formed therein near the periphery thereof (there being preferably eight openings as shown more clearly in FIGS. 7 and 9) and a permanent magnet member 39 (preferably cylindrically formed) is suitably secured in each of the openings.

A stator assembly 40 is carried on the free end of the cantilever-mounted shaft within the housing. As shown more clearly in FIG. 9, the stator assembly includes a substantially annular stator housing 41 having an annular clearance relative to the cylindrical housing. The stator assembly has a bore 42 and further has a rearwardly-facing annular peripheral lip 43 formed therein. A first planar (rearward) spider member 44 has a plurality of radially-extending circumferentially-spaced projections 45 secured to the lip of the annular stator housing by screws 46. A second planar (forward) spider member 47 has a plurality of radially-extending circumferentially-spaced projections 48. Each of these projections 48 on the second spider member has a rearwardly-extending portion 49 having a right-angularly bent outwardly-extending element 50. The elements 50 are secured to the annular lip by means of screws 51, thereby securing the second spider member within the annular stator housing.

Figure 6:
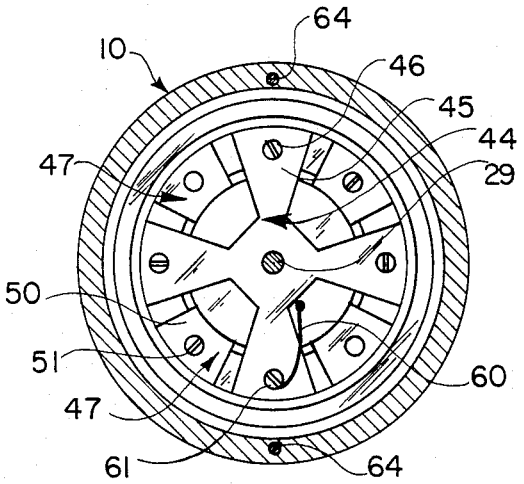
FIG. 6 is a cross-sectional view, taken across the lines 6—6 of FIG. 5, and looking into the rear of the stator assembly.

As best shown in FIG. 6, the first and second spider members are staggered circumferentially with respect to each other. The first spider member 44 is sweated onto the free end of the stationary shaft (or otherwise brazed or secured thereto). Since the first spider member is secured to the annular stator housing, the entire stator assembly is supported on the free end of the cantilever-mounted stationary shaft within the housing. A spacer (or washer) 52 is carried on the shaft and is disposed axially between the stator and rotor assemblies. At least the first spider member is made of a magnetic material (such as soft iron) and the attraction of the permanent magnets on the rotor assembly urges the rotor assembly forwardly of the housing and tends to maintain the rotor assembly in its proper position on the shaft, thereby assuring that the impeller will be axially aligned relative to the radially-extending canals in the disc member.

A coil or bobbin 53 is nested between the spider members within the annular stator housing. The hub of the coil carries a collar 54, and a cylindrical plug 55 of magnetic material is received within the collar.

A lamp assembly 56 includes a flashlight type of bulb 57 in a socket 58 formed integrally with the annular stator housing. The lamp assembly further includes a reflector 59 threadably mounted on the socket and surrounding the bulb.

As shown more clearly in FIGS. 5 and 6, the positive electrical connection to the bulb is made from a first lead 60 coming off the coil and secured to the first spider member by a screw 61, then from the first spider member to the plug within the coil, and from the plug to the tip in the base of the bulb. The plug thus forms the dual function of making the positive electrical connection and concentrating the flux density within the coil. The negative electrical connection is made from a second lead 62 which comes out of the annular stator housing and enters through aligned small holes in the reflector and collar and into contact with the threaded portion of the lamp base.

Figure 1:
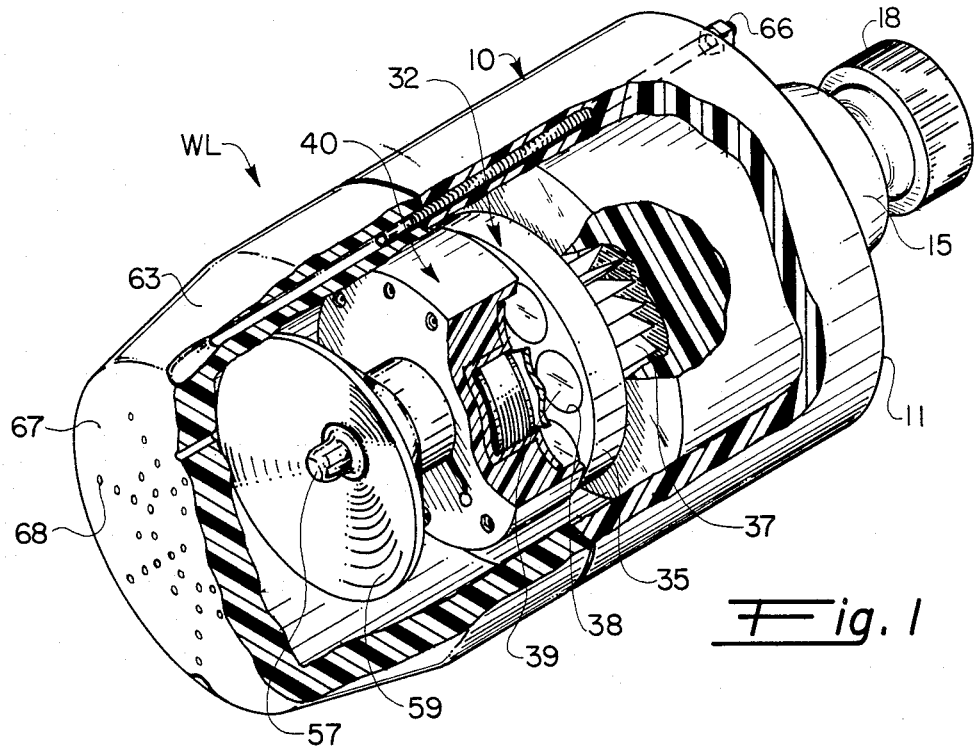
FIG. 1 is a perspective of a preferred embodiment of the water light of the present invention, with parts broken away and sectioned.
Figure 2:
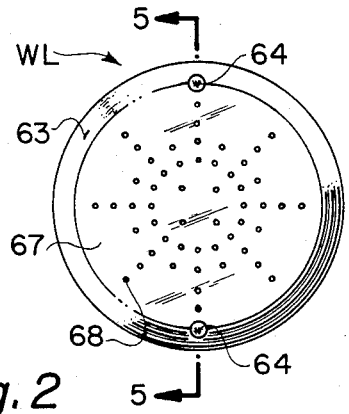
FIG. 2 is a front end view thereof.
Figure 3:
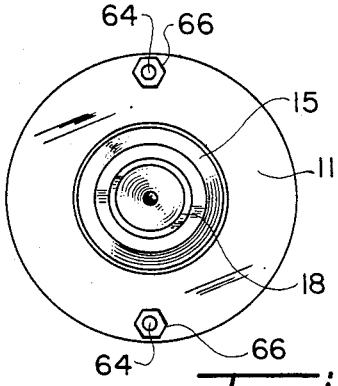
FIG. 3 is a rear end view thereof.
Figure 4:
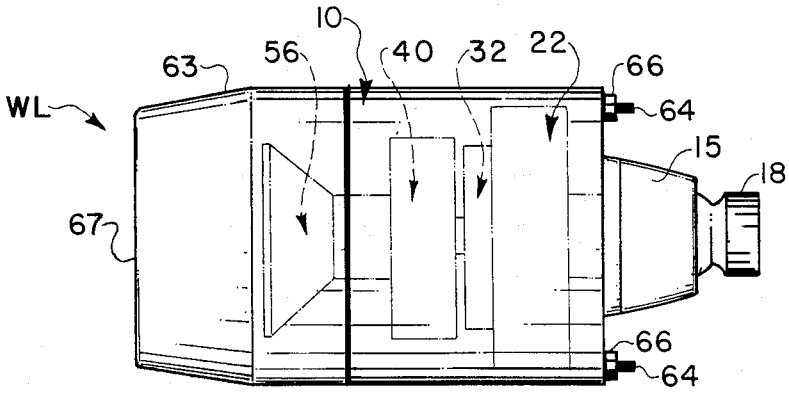
FIG. 4 is a side elevation thereof.

As shown more clearly in FIGS. 1, 5 and 6, a generally cylindrical lens cap 63 is secured to the housing axially forwardly thereof. Screws 64 are anchored in the lens cap end pass through longitudinal bores 65 in the housing, and the screws receive respective nuts 66 to thereby removably secure the lens cap to the housing. The lens cap has substantially-flat front end wall 67 having a plurality of apertures 68, as shown more clearly in FIG. 2. The configuration of the apertures 68 will result in a fine decorative spray, which will be illuminated by the bulb.

In operation, water under pressure enters into the coupling 18, through port 20, chamber 21, plenum 25, axially-extending canals 27 in the disc member 22, radially-extending canals 28 into the blind axial bore 23 in the disc member 22, around the impeller 36, past the rotor assembly 32, axially through the annular clearance between the stator assembly 40 and the housing 10, past the reflector 59 of the lamp assembly 56, into the lens cap 63, and out of the apertures 68 in the front end wall 67 of the lens cap. The rotor assembly 32 is axially spaced from the stator assembly 40, but in close proximity thereto; and upon rotation of the rotor assembly 32 due to the water flow, a voltage is generated in the coil 53 in the stator assembly 40 which energizes the bulb 57 in the lamp assembly 56, as the fine water spray is emitted out of the apertures 68 in the flat end wall 67 of the lens cap 63.

Figure 10:
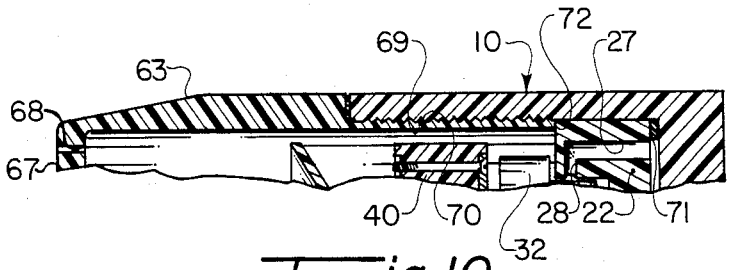
FIG. 10 corresponds to a portion of FIG. 5, but shows an alternate embodiment for assembling the water-powered light of the present invention.

With reference to FIG. 10, an alternate embodiment is illustrated, wherein the housing 10 is internally threaded (as at 69) to receive external threads 70 on the lens cap 63, thereby removably securing the lens cap to the housing. An O-ring 71 is disposed between the disc member 22 and the end wall 11 of the housing, thereby providing a gasket within the plenum 25, and the lens cap has a rearward annular edge 72 abutting against the disc member 22. With this arrangement, the disc member 22 is clamped within the housing, and an adhesive between the disc member 22 and the housing 10 is not necessary. Moreover, the disc member 22, stationary shaft 29, rotor assembly 32, stator assembly 40 and lamp assembly 56 may be assembled as an integral subassembly; and this integral subassembly may be inserted into the housing 10 through the front open end 12 thereof and secured in place as the lens cap 63 is screwed down onto the housing 10.

Figure 11:
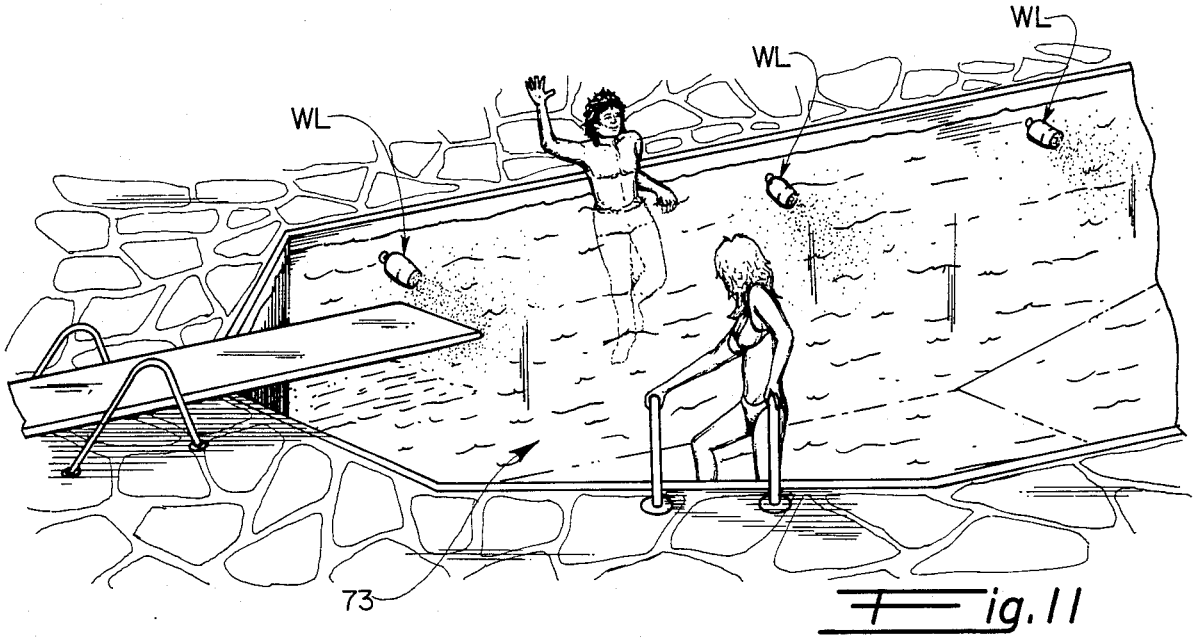
FIG. 11 illustrates the application of the water light of the present invention to a swimming pool.

With reference to FIG. 11, the improved water light WL of the present invention may be used for decorative purposes in a swimming pool 73.

Figure 12:
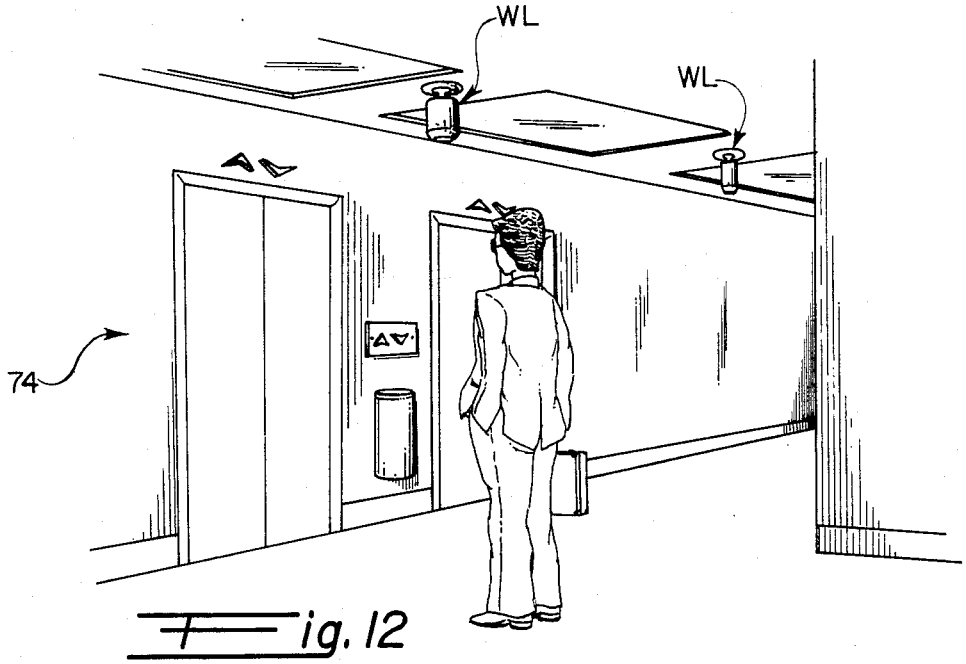
FIG. 12 illustrates the application of the water light of the present invention to a sprinkler system in a modern office building.

With reference to FIG. 12, the improved water light WL of the present invention may be used for utilitarian purposes on one or more sprinkler heads in a modern office building 74 (or other structure).

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A water-powered light comprising, in combination, a housing having a pair of end portions, one of which is substantially closed and the other of which is substantially open, a stationary shaft means having one end cantilever supported at the closed end portion of the housing, the shaft means projecting therefrom substantially axially of the housing and having a free end within the housing, a rotor assembly journaled on the shaft means, the rotor assembly including an impeller and further including a rotor member, passageway means within the closed end portion of the housing for directing water flow to the impeller, thereby driving the rotor assembly, permanent magnet means carried on the rotor member, a stator assembly mounted on the free end of the shaft means, the stator assembly being disposed axially forwardly of the rotor assembly and having an annular clearance relative to the housing, the stator assembly including a stator housing having first and second stator members secured therein and further having a coil nested between the stator members, a lamp assembly in the housing forwardly of the stator assembly and electrically connected thereto, and lens means mounted on the open end portion of the housing forwardly of the lamp assembly, the lens means having aperture means formed therein, whereby the water may flow out of the rotor assembly, through the annular clearance between the stator assembly and the housing, and out of the aperture means in the lens means.

2. The combination of claim 1, wherein the housing is substantially cylindrical, and wherein the closed end portion of the housing includes an end wall and further includes a cylindrical disc member mounted within the housing forwardly of the end wall, the disc member having a base portion and further having a relatively-shallow blind axial bore formed therein, forwardly of the base portion thereof, and wherein the stationary shaft means is carried by the disc member.

3. The combination of claim 2, wherein the impeller is nested within the blind axial bore of the disc member, and wherein the passageway means is formed within the disc member and includes a plurality of circumferentially-spaced axially-extending canals and further includes a corresponding plurality of radially-extending canals communicating with the axially-extending canals and opening into the blind axial bore in the disc member for directing the water flow on to the periphery of the impeller.

4. The combination of claim 2, wherein the shaft means comprises a bolt having a head and further having an end secured to the base of the disc member.

5. The combination of claim 4, wherein the first stator member comprises a first spider member secured to the head of the bolt, wherein the stator housing is substantially annular and is secured to the first spider member, and wherein the second stator member comprises a second spider member secured within the annular stator housing.

6. The combination of claim 5, wherein the stator housing includes a rearward portion provided with an annular lip, wherein each of the spider members has a plurality of circumferential-spaced radially-extending projections, the projections on the second spider member including rearwardly-extending portions having right-angularly bent outwardly-extending elements, the elements on the second spider member and the projections on the first spider member being circumferentially staggered with respect to each other, and respective means for securing the projections on the first spider member and the elements on the second spider member to the annular lip on the stator housing.

7. The combination of claim 1, wherein the permanent magnet means carried on the rotor member comprises a plurality of circumferentially-spaced openings formed near the periphery of the rotor member, and a permanent magnet member received in each of the openings.

8. The combination of claim 7, wherein the rotor assembly is attracted to the stator assembly and is constantly urged forwardly of the housing, and wherein a spacer is carried on the shaft means between the stator and rotor assemblies.

9. The combination of claim 1, wherein the lamp assembly is secured to the stator assembly forwardly thereof, the lamp assembly including a bulb and further including a reflector surrounding the bulb.

10. The combination of claim 2, wherein the lens means comprises a substantially-cylindrical elongated lens cap mounted on the open end portion of the housing and extending forwardly therefrom, the lens cap having a substantially flat end wall, and wherein the aperture means comprises a plurality of apertures formed in the end wall of the lens cap.

11. The combination of claim 10, wherein the housing has longitudinal through boxes formed therein, wherein respective screws are carried by the lens cap and pass through the longitudinal through bores in the housing, and wherein respective nuts are carried on the end of the screws.

12. The combination of claim 10, wherein the housing is provided within internal threads, wherein external treads are formed on the lens cap, wherein the lens cap has a rearward annular edge abutting against the disc member, and wherein an O-ring is disposed between the disc member and the end wall of the housing, whereby the disc member, stationary shaft means, rotor assembly, stator assembly and lamp assembly may be assembled as an internal subassembly and inserted through the forward open end portion of the housing, and whereby said subassembly will be retained within the housing by means of the lens cap.

13. A water-powered light comprising, in combination, a substantially-cylindrical housing having a pair of end portions, one of which is closed by an end wall and other of which is substantially open, a cylindrical disc member mounted within the housing forwardly of the end wall, the disc member having a base portion and further having a relatively-shallow blind axial bore formed therein forwardly of the base portion thereof, a fixed shaft have one end cantilever mounted on the base of the disc member, the shaft extending forwardly therefrom and having a free end within the housing, a rotor assembly journaled on the shaft, the rotor assembly including an impeller and further including a rotor member, the impeller being nested within the blind axial bore of the disc member, passageway means within the closed end portion of the housing for directing water flow to the impeller, thereby driving the rotor assembly, the passageway means including a plenum between the end wall and the disc member, further including a plurality of circumferentially-spaced axially-extending canals formed in the disc member and communicating with the plenum, and further including a corresponding plurality of radially-extending canals communicating with the axially-extending canals and opening into the blind axial bore in the disc member, permanent magnet means carried on the rotor member and including a plurality of circumferentially-spaced openings formed near the periphery of the rotor member, and further including a permanent magnet member received in each of the openings, a stator assembly mounted on the free end of the fixed shaft, the stator assembly being disposed axially forwardly of the rotor assembly and having an annular clearance relative to the housing, wherein the rotor assembly is attracted to the stator assembly and is constantly urged forwardly of the housing, spacer means between the stator and rotor assemblies, the stator assembly including a coil nested therein and cooperating electrically with the permanent magnet means on the rotor assembly to induce a voltage in the coil, a lamp assembly carried by the stator assembly forwardly in the housing and electrically connected to the coil, the lamp assembly including a bulb and further including a reflector surrounding the bulb, a substantially-cylindrical elongated lens cap mounted on the open end portion of the housing and extending forwardly therefrom, the lens cap including a substantially flat end wall having a plurality of apertures formed therein, whereby the water may flow out of the rotor assembly, through the annular clearance between the stator assembly and the housing, and out of the apertures in the end wall of the lens cap.

14. The combination of claim 13, wherein the housing is provided within internal threads, wherein external threads are formed on the lens cap, wherein the lens cap has a rearward annular edge abutting against the disc member, and wherein an O-ring is disposed between the disc member and the end wall of the housing, whereby the disc member, fixed shaft, rotor assembly, stator assembly and lamp assembly may be assembled as an integral subassembly and inserted through the forward open end portion of the housing, and whereby said subassembly will be retained within the housing by means of the lens cap.

15. The combination of claim 14, wherein the stator assembly comprises an annular stator housing including a rearward portion provided with an annular lip, a first planar spider member secured to the free end of the fixed shaft and having a plurality of circumferential-spaced radially-extending projections, a second planar spider member having a plurality of circumferentially-spaced radial projections, the projections on the second spider member including rearwardly-extending portions having right-angularly bent outwardly-extending elements, the elements on the second spider member and the projections on the first spider member being circumferentially staggered with respect to each other, and respective means for securing the projections on the first spider member and the elements on the second spider member to the annular lip on the stator housing.

16. In a water powered light, the combination of a cylindrical housing having a blind axial bore and further having a closed end wall, a gasket within the bore and seated against the end wall, a disc member within the bore and seated against the gasket, a lens cap secured to the housing and having a portion abutting against the disc member, thereby securing the disc member within the housing, a fixed shaft having one end thereof carried by the disc member, projecting therefrom, and having a free end within the housing, a rotor assembly journaled on the shaft, the rotor assembly including permanent magnet means and further including an impeller in juxtaposition to the disc member, passageway means formed in the end wall of the housing and in the disc member for directing water flow to the impeller, a stator assembly carried on the free end of the fixed shaft axially forwardly of the rotor assembly, and a lamp assembly carried by the stator assembly forwardly thereof, whereby the disc member, fixed shaft, rotor assembly, stator assembly and lamp assembly may be assembled as an integral subassembly, and whereby the subassembly may be inserted through the bore in the housing and retained therein by the lens cap, and means for exit of the water out of the housing.

* * * * *